US005321480A

United States Patent [19]

Merle et al.

[11] Patent Number: 5,321,480

[45] Date of Patent: Jun. 14, 1994

[54] FUSER HAVING A DETACHABLE BELT

[75] Inventors: Thomas C. Merle; Kevin M. Johnson, both of Rochester, N.Y.

[73] Assignee: Eastman Kodak Company, Rochester, N.Y.

[21] Appl. No.: 57,393

[22] Filed: May 6, 1993

[51] Int. Cl.[5] ..... G03G 15/20

[52] U.S. Cl. ..... 355/285; 355/282; 355/295

[58] Field of Search ..... 355/282, 285, 290, 295; 219/216; 118/60

[56] References Cited

U.S. PATENT DOCUMENTS

| | | | |
|---|---|---|---|
| 3,089,363 | 5/1963 | Wallace et al. . | |
| 3,552,957 | 1/1971 | Hodges . | |
| 3,619,050 | 11/1971 | Swanke . | |
| 3,948,215 | 4/1976 | Namiki | 118/60 |
| 4,155,639 | 5/1979 | Bejerano et al. . | |
| 4,582,416 | 4/1986 | Karz et al. | 219/216 X |
| 4,711,549 | 12/1987 | Roodbeen | 219/216 X |
| 5,051,784 | 9/1991 | Yamamoto et al. | 355/285 |
| 5,119,142 | 6/1992 | Swapceinski et al. | 355/285 |
| 5,149,941 | 9/1992 | Hirabayashi et al. | 219/216 |
| 5,153,656 | 10/1992 | Johnson et al. | 355/290 |
| 5,157,447 | 10/1992 | Farnand et al. | 355/290 |
| 5,164,782 | 11/1992 | Nagayama et al. | 355/285 |
| 5,196,675 | 3/1993 | Suzuki et al. | 219/216 |

*Primary Examiner*—A. T. Grimley
*Assistant Examiner*—Sandra L. Brasé
*Attorney, Agent, or Firm*—Leonard W. Treash

[57] ABSTRACT

A fuser for fusing toner images to a receiving sheet includes a pressure roller and a fusing belt. The fusing belt has leading and trailing ends. A towing device is positioned to receive both the leading and trailing ends of the belt to form an endless belt. The towing device is moved through a path which moves the fusing belt through an endless path, which path includes a fusing nip with the pressure roller. The belt is backed by a heated roller at the fusing nip which defines a portion of the endless path and cooperates with the pressure roller to provide pressure in the nip.

22 Claims, 5 Drawing Sheets

FUSER HAVING A DETACHABLE BELT

This invention relates to a fuser generally of the type used to fix a toner image to a receiving sheet. More particularly, it relates to a fuser having two fusing members for applying both heat and pressure to a toner image in which one of the fusing members is an endless belt.

U.S. Pat. Nos. 5,089,363 and 5,119,142 are representative of references which show toner image fusers which include an endless belt for contacting a toner image carried on a receiving sheet. The belt is usually backed by a heated roller and the receiving sheet is fed between the belt and a pressure member, for exampoe, a pressure roller having a slight amount of compliance. In high gloss applications, the belt is hard and smooth. For example, it can be formed of electroformed nickel, Kapton®, stainless steel, or a hard, smooth plastic. The toner image is maintained in contact with the belt until the image cools below its glass transition temperature. Once cooled, the receiving sheet and image can be separated as the belt goes around a small roller. The cooling of the image before separation permits separation without offset which may eliminate a need for liquid release agents. Such belt fusers are preferred over conventional roller fusers for high quality, high gloss color applications. See also U.S. Pat. No. 3,948,215 and European Patent Application 0 295 901.

Existing fusing belts are manufactured as closed loops, generally with a seam. The belt is put in motion through frictional contact with a drive roller. This requires that the belt be put under sufficient tension to establish the appropriate frictional force. The tension, in turn, requires an active steering system to ensure reliable performance. Replacement of the belt is generally done in the axial direction, which generally requires that the supports for the belt be cantilevered, at least during the replacement process.

U.S. Pat. No. 3,619,050 to Swanke, issued Nov. 9, 1971, shows use of a chain driven tow bar for spreading a long photoconductive web through an endless path in an image forming apparatus. See also U.S. Pat. Nos. 4,155,639, Bejerano et al, issued May 22, 1979, and 3,552,957, Hodges, issued Jan. 5, 1971.

SUMMARY OF THE INVENTION

It is an object of the invention to provide a fuser of the general type using a belt but without many of the mechanical disadvantages associated with such belts.

This and other objects are accomplished by a fuser which includes a first pressure member, a towing means for receiving a leading end of a fusing belt, and means for moving the towing means through a path such that a received fusing belt is towed through an endless path. A second pressure member is positioned to define a portion of the endless path of the fusing belt and to urge the fusing belt toward the first pressure member to form a pressure fusing nip between the belt and the first pressure member.

According to a preferred embodiment, the fuser includes a pair of timing belts, each of which includes a fastening device for receiving the leading end of the fusing belt. At installation, the leading end of the fusing belt is placed over the fastening device and the timing belts are moved through respective endless paths which threads the fusing belt in the fuser. The trailing end is then secured to the same or an adjacent fastening device.

According to another preferred embodiment, the fusing belt is backed by a heated roller in the pressure fusing nip. To maintain continuity of the fusing belt in the nip despite reduced tension, a prenip roller is mounted upstream of the nip to press the fusing belt against the heated roller. The prenip roller reduces air gaps that may exist and positions the fusing belt for the nip and maintains thermal contact between the belt and the heated roller.

An advantage of the preferred embodiments is that the fusing belt is driven by the towing means and not by frictional contact with a roller. Thus, substantial tension need not be placed on the fusing belt greatly reducing tracking problems as well as fatigue.

The preferred embodiments have the further advantage of permitting loading of the fusing belt from a position other than the ends of the supporting rollers. This greatly simplifies the loading process and eliminates the need that the supporting rollers be cantilevered.

DESCRIPTION OF THE PREFERRED EMBODIMENTS

Figure 1:
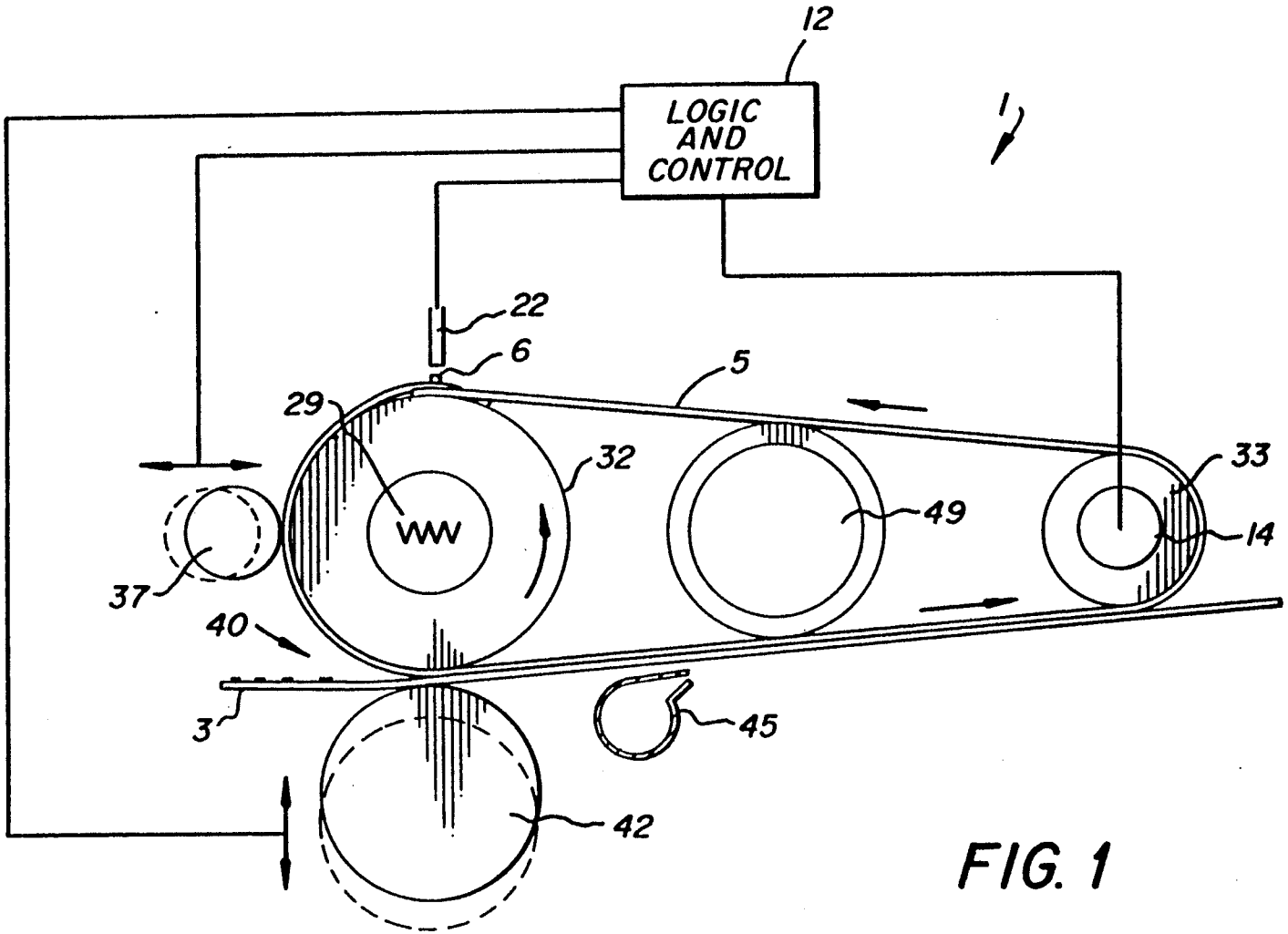
FIG. 1 is a side schematic of a fuser.

Referring to FIG. 1, a fuser 1 includes a fusing belt 5 trained about a heated roller 32 and a separation roller 33 to move through an endless path. The endless path takes the fusing belt 5 through a heated pressure fusing nip 40 formed between fusing belt 5, where backed by heated roller 32, and a pressure roller 42. Pressure roller 42 and heated roller 32, thus, constitute first and second pressure members, respectively, which provide pressure between fusing belt 5 and roller 42 in nip 40. Heat in nip 40 is preferably supplied gy heated roller 32, but could alternatively be supplied by heating pressure roller 42 and/or by a preheating device, not shown.

In operation, a receiving sheet 3 having a toner image on its top side is fed into fusing nip 40. The combination of heat and pressure in fusing nip 40 fixes the toner image to the receiving sheet 3. The receiving sheet 3 is maintained in contact with fusing belt 5 after leaving nip 40. The fusing belt and toner image are cooled by a suitable air cooling device 45 and a heat transfer device 49. Heat transfer device 49 transfers heat from a portion of belt 5 in contact with the receiving sheet 3 to a portion of fusing belt 5 moving back into contact with heated roller 32. The toner image is cooled to a temperature below its glass transition temperature before it reaches separation roller 33. The fusing belt 5 moves around separation roller 33, but the receiving sheet 3 has sufficient beam strength to cause it to refuse to continue with the belt and, thus, separates from belt 5. Because the toner image is cooled below its glass transition temperature before separation, it does not have a tendency to offset onto the fusing belt, even without the use of offset-preventing liquids. Further, if the belt is hard and smooth, a high gloss is obtainable.

Figure 5:
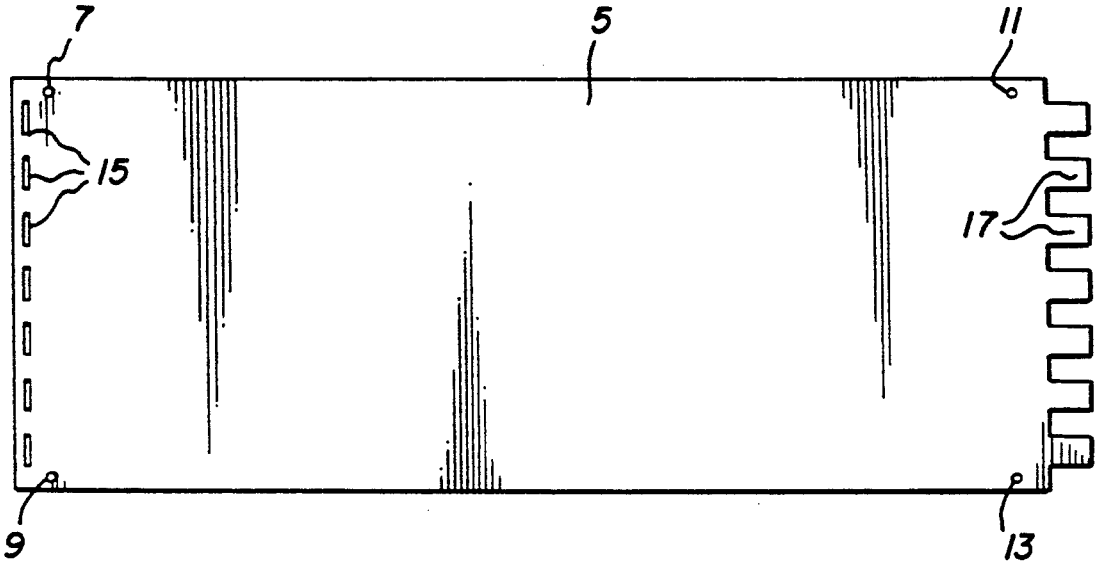
FIG. 5 is a top view of a fusing belt separate from the fuser shown in FIG. 1.

To eliminate the need for special belt tracking devices and to simplify the replacement and installation of the belt, belt 5 is not supplied as a completed loop. Referring to FIG. 5, fusing belt 5 is rectangular and has circular holes 7 and 9 adjacent its leading end and circular holes 11 and 13 adjacent its trailing end. The leading end also has slots 15 and the trailing end has tabs 17.

Figure 2:
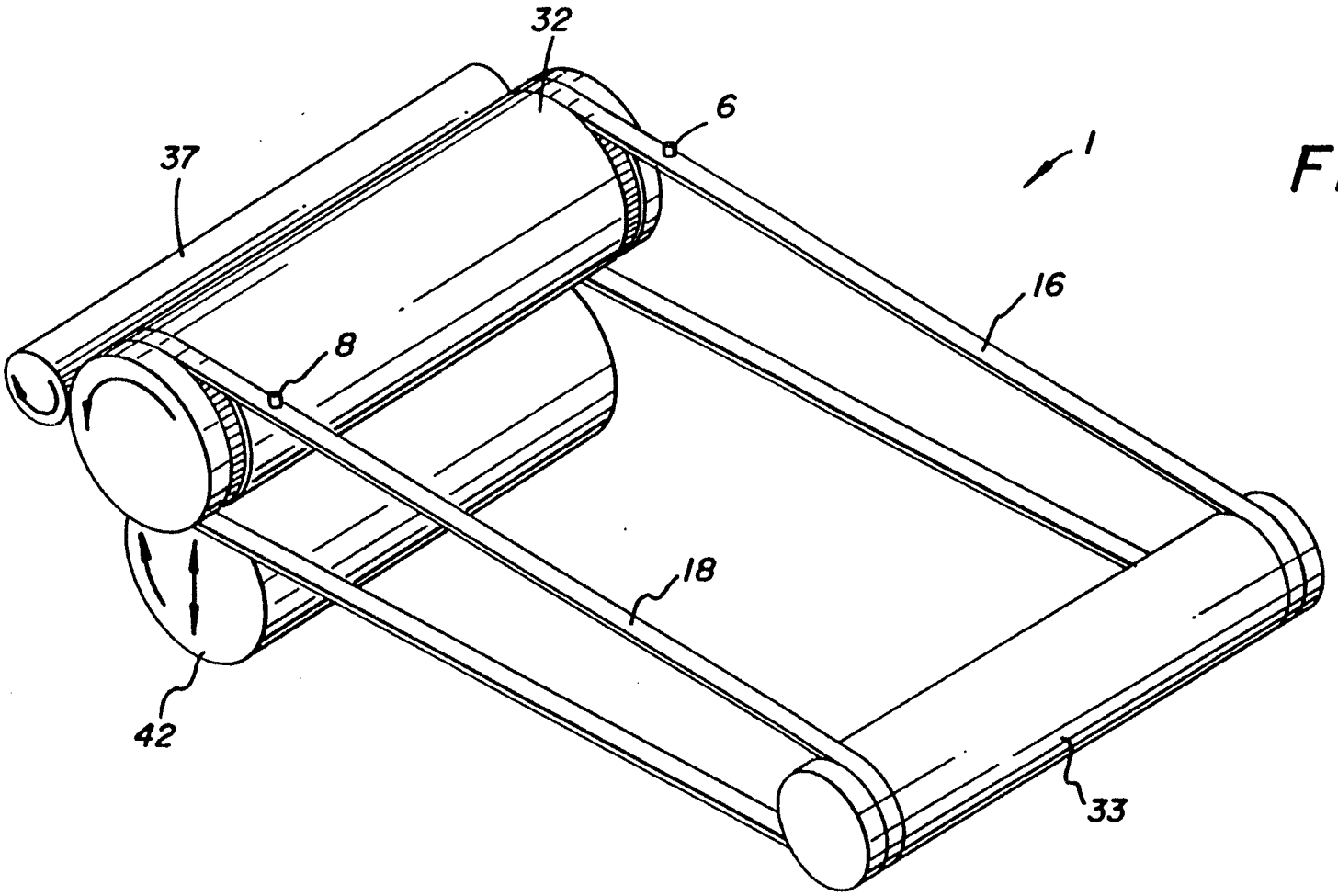
FIGS. 2, 3 and 4 are perspective views of the fuser shown in FIG. 1, illustrating different conditions of assembly of a fusing belt.
Figure 3:
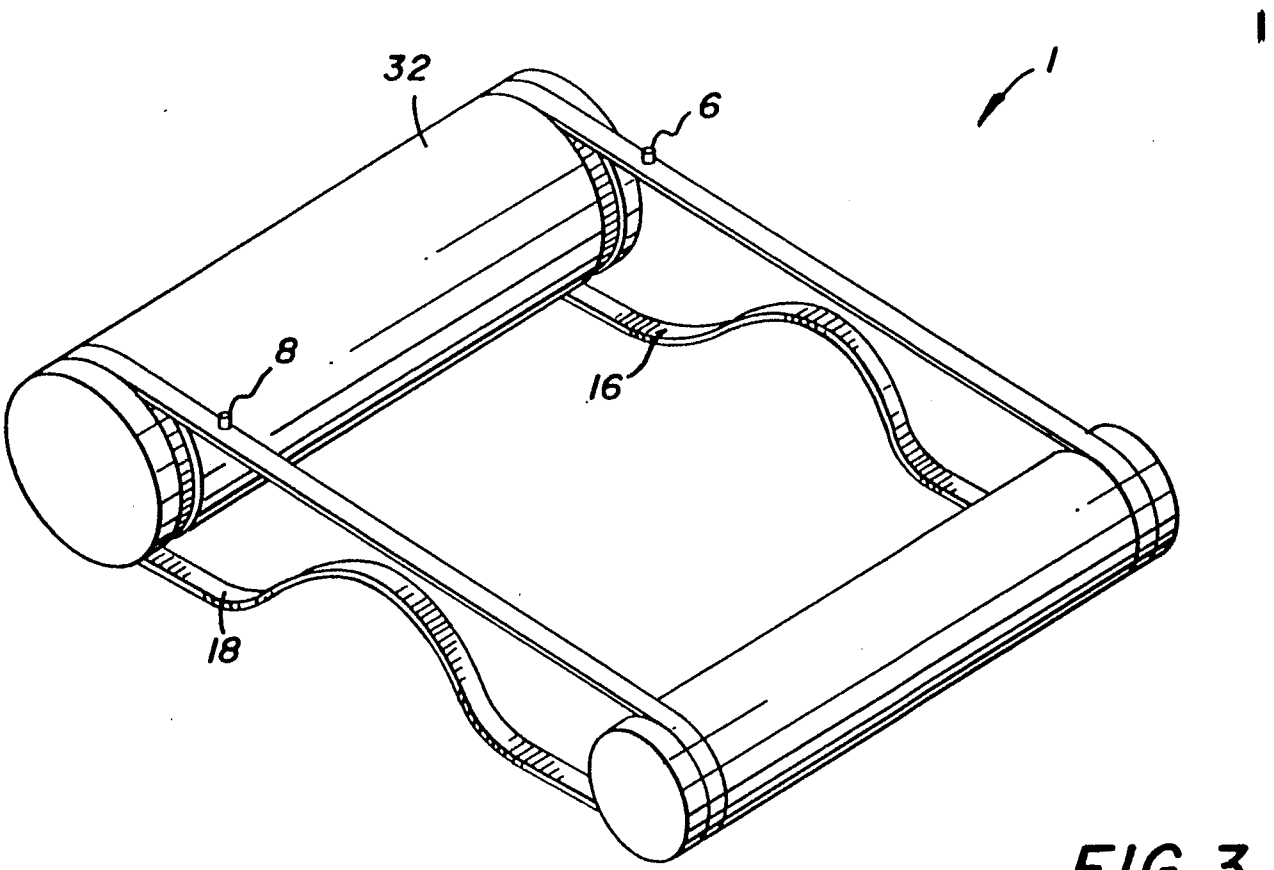
Figure 4:
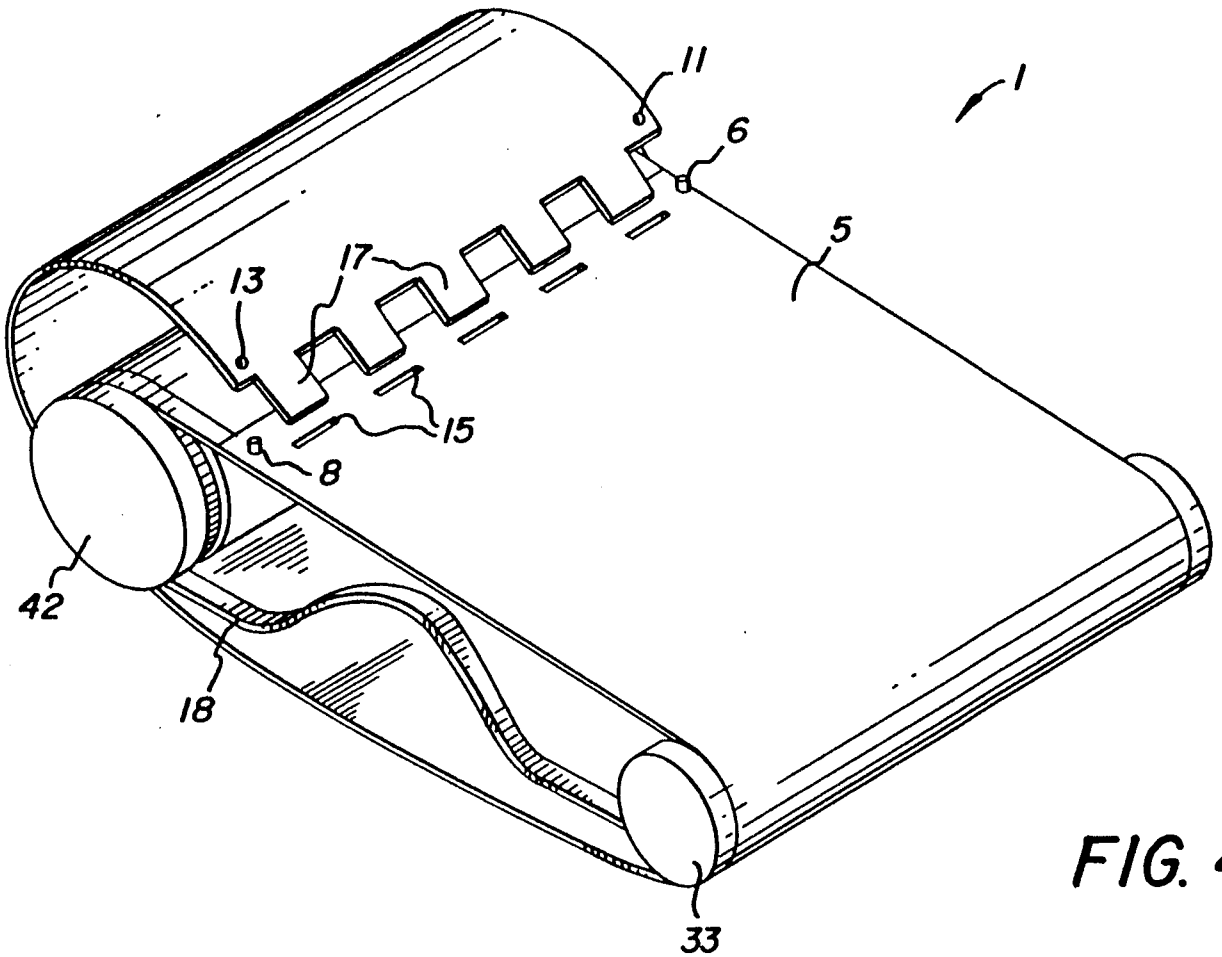

As best seen in FIGS. 2, 3 and 4, fuser 1 further includes a pair of timing belts 16 and 18 which are trained around suitable timing belt tracks in rollers 32 and 33. The timing belts each have a fastening device, for example, pins 6 and 8. The circular holes 7 and 9 in the leading end of fusing belt 5 are placed over pins 6 and 8. A motor 14 (FIG. 1) is operated to drive roller 33 to move the timing belts 16 and 18 to thread the fusing belt 5 through the fuser 1 until circular holes 11 and 13 adjacent the trailing end of belt 5 can also be placed over pins 6 and 8, as shown best in FIG. 4. Clips, not shown, are placed on pins 6 and 8 to hold the leading and trailing ends of fusing belt 5 thereon. To facilitate placing of the trailing end over pins 6 and 8, the rollers can be moved closer together which will apply some slack to the timing belts, as shown in FIG. 3. Also as shown in FIG. 4, the tabs 17 in the trailing end of the fusing belt can be inserted in the slots 15 in the leading end to smooth the fusing belt 5 in the attachment area. Alternatively, a pair of pins slightly spaced from pins 6 and 8 can be used for the trailing end holes 11 and 13.

After loading of the sheet is completed, the slackness is taken up by articulating the separation roller 33 away from the heated roller 32, or vice-versa. Alternatively, a takeup roller can be moved into position, training the fusing belt about three rollers. The heated roller 32 is separated from the separation roller 33 by a distance that applies enough tension to the timing belts 16 and 18 that they can be driven by separation roller 33 (or heated roller 32). However, that distance does not provide much tension in fusing belt 5, allowing it to be driven by pins 6 and 8.

Starting of motor 14 begins to move the fusing belt 5 at the normal process speed. As the belt comes in contact with the heated fusing roller 32, a prenip roller 37 is moved toward heated roller 32 to force the fusing belt 5 smoothly onto the roller surface. This reduces any air gaps that may exist and also assures that the belt 5 is properly positioned before it enters the fusing nip 40. By reducing the air gaps and applying a minimal force, thermal contact resistance is reduced and, thus, the fusing belt 5 preheats properly before entering nip 40. The pressure roller 42 is moved into position and the receiving sheet 3 is introduced into nip 40 to begin the fusing process which takes place under increased temperature and high pressure. As described above, the belt 5 and receiving sheet go through the cooling section and the receiving sheet is released at the separation roller.

The attachment area on the belt 5 where the slots and tabs are located is considered a nonactive area for fusing. Referring to FIG. 1, sensor 22 senses the passage of pins 6 and 8 and creates a signal which is sent to a logic and control 12. Logic and control 12 controls not only the feeding of the receiving sheet 3 to avoid the nonactive area but also controls the movement of prenip roller 37 and pressure roller 42 to avoid the nonactive area as well.

During the time that high pressure is established in fusing nip 40, the fusing belt may tend to steer to one side of the separation roller because of lack of perfect orientation between the fusing roller and the pressure roller. However, during the time when the high pressure nip is not established as the slots and tabs go through the nip area, there will be no tendency for the fusing belt to steer. At this point in the process, the fusing belt corrects its position and returns to a self-adjusted operating point influenced by the towing means and pins 6 and 8. This is enabled by the fact that there is very little tension in the belt and movement axially along the separation roller is unconstrained. Reduction of high tension, in addition to reducing steering problems, also reduces fatigue of the belt, extending its life.

Although the timing belts are a convenient, precise way to secure and drive the fusing belt, a chain drive and tow bar or other comparable means could also be used.

Replacement of the belt is easily effected even though both ends of the rollers are permanently supported between mechanism plates of the fuser. This is far superior to the cantilevered construction necessary with continuous belt systems. Further, no disassembly of an end support or the like during installation or removal is necessary.

Replacement of the belt can be accomplished even though the fuser has not cooled completely because the belt can be handled in a cool section of the system. Automated replacement of the belt can be also facilitated. For example, reference is made to U.S. Pat. No. 3,619,050, referred to above, showing an automated replacement scheme adaptable to this invention.

In general, the belt is manufactured, replaced and shipped as a sheet having opposite ends. Shipment can be in a cylinder similar to that for holding posters.

Greatest interest in fusing belts is in high gloss applications. For such applications, a hard, smooth fusing surface is necessary, typically provided by a metal or hard plastic belt. The belt can be covered by a silicone or other release material. If a textured image is desired, a softer belt would be preferred, for example, a belt with a silicone rubber fusing surface.

The invention has been described in detail with particular reference to a preferred embodiment thereof, but it will be understood that variations and modifications can be effected within the spirit and scope of the invention as described hereinabove and as defined in the appended claims.

We claim:

1. A fuser comprising:

a first pressure member, towing means for receiving and securing a leading end of a fusing belt having leading and trailing ends and a laterally central fusing portion, means for moving the towing means through a path to tow a received fusing belt and its central fusing portion through an endless path, and a second pressure member positioned to define a portion of the endless path of the fusing belt and to urge the fusing belt toward the first pressure member to form a pressure fusing nip, said towing means including a pair of timing belts positioned outside of and generally parallel to the path of the central fusing portion of the fusing belt and fastening means also positioned laterally outside of the path of the central fusing portion and fixed to each timing belt for fastening leading and trailing ends of a received fusing belt to the timing belts.

2. A fuser according to claim 1 wherein the fastening means is a pin fixed to each timing belt for insertion in holes positioned in both the leading and trailing ends of a received fusing belt.

3. A fuser according to claim 1 further including a prenip roller engageable with the fusing belt upstream of said pressure fusing nip to assure continuous contact between the belt and the second pressure member.

4. A fuser according to claim 1 wherein the second pressure member is a heated roller having a periphery which partially defines the endless path of the fusing belt.

5. A fuser according to claim 1 further including means for heating said nip.

6. A fuser according to claim 1 further including a separation roller positioned to also partly define the endless path and having a small enough size that movement of the fusing belt around a portion of its periphery separates a receiving sheet from the belt.

7. A fuser according to claim 1 further including a prenip roller engageable with the fusing belt upstream of said pressure fusing nip to assure continuous contact between the belt and the second pressure member.

8. A fuser according to claim 7 further including a separation roller positioned to also partly define the endless path and having a small enough size that movement of the fusing belt around a portion of its periphery separates a receiving sheet from the belt.

9. A fuser comprising:

a pressure roller, a heated roller, a metallic fusing belt having a leading end and a trailing end and a laterally central fusing portion and belt fastening means at each of the leading and trailing ends, laterally outside of and on each side of the central fusing portion, towing means for receiving and fastening both the leading and the trailing end of the fusing belt, and means for moving the towing means through a path which path moves the fusing belt through an endless path partially defined by the heated roller and forming a fusing nip with the pressure roller, said towing means including a pair of timing belts positioned laterally outside of the central fusing portion and generally parallel to the path of the fusing belt and fastening means also positioned laterally outside of the central fusing portion and fixed to each timing belt for cooperating with the belt fastening means for fastening leading and trailing ends on the belt.

10. A fuser according to claim 9 further including a separation roller positioned to also partly define the endless path and having a small enough size that movement of the fusing belt around a portion of its periphery separates a receiving sheet from the belt.

11. A fuser according to claim 10 wherein the length of the fusing belt and operative positions of the heated and separation rollers is such that little tension is applied to the fusing belt during operation.

12. A fuser according to claim 9 wherein said fastening means on each of said timing belts is a pin and the belt fastening means are holes which fit over the pins.

13. A fuser according to claim 12 including a motor for rotating one of said heated roller and separation roller to drive the timing belts through their endless paths.

14. A fuser according to claim 9 further including first and second timing belts movable through endless paths, respectively, and a pin supported by each timing belt for securing the leading and trailing ends of the fusing belt and for moving the fusing belt through its endless path.

15. A fuser according to claim 14 including a separation roller defining a portion of the endless path of the fusing belt, said timing belts being trained about said heated roller and said separation roller.

16. A fuser according to claim 15 wherein the heated roller and separation roller are separated by a distance relative to the length of the timing belts and the fusing belt that the timing belts are under enough tension to be driven by one of the heated and separation rollers, but the fusing belt is under insufficient tension to be driven by the separation or heated rollers.

17. A fuser according to claim 9 further including a prenip roller positioned in operation to contact the fusing belt upstream of the fusing nip to force the fusing belt against the heated roller.

18. A fusing belt for use in a fuser having a towing means for receiving and securing leading and trailing ends of a fusing belt, which towing means has a pair of pins to which the leading and trailing ends are secured, said fusing belt comprising means defining the leading and trailing ends and a laterally central fusing portion, each of said ends having a hole laterally outside of the central fusing portion on each side of the central fusing portion for positioning over the securing means of a receiving fuser.

19. A fusing belt according to claim 18 wherein said belt is constructed of metal and has a smooth hard surface.

20. A fuser comprising:

a first pressure member, towing means for receiving and securing a leading end of a fusing belt having leading and trailing ends, means for moving the towing means through a path to tow a received fusing belt through an endless path, a second pressure member positioned to define a portion of the endless path of the fusing belt and to urge the fusing belt toward the first pressure member to form a pressure fusing nip, and a prenip roller engageable with the fusing belt upstream of said pressure fusing nip to assure continuous contact between the belt and the second pressure member.

21. A fuser comprising:

a pressure roller, a heated roller, a metallic fusing belt having a leading end and a trailing end, towing means for receiving and fastening both the leading and the trailing end of the fusing belt, means for moving the towing means through a path which path moves the fusing belt through an endless path partially defined by the heated roller and forming a fusing nip with the pressure roller, and a prenip roller positioned in operation to contact the fusing belt upstream of the fusing nip to force the fusing belt against the heated roller.

22. A fuser according to claim 21 wherein at least one of the pressure roller and prenip roller are movable to a position out of contact with the belt and said fuser includes means for sensing the location of said fastening means and for creating an electrical signal in response to such sensing, and means for controlling the position of one of the prenip roller and the pressure roller in response to said signal to avoid contact with said fastening means.

* * * * *

UNITED STATES PATENT AND TRADEMARK OFFICE

CERTIFICATE OF CORRECTION

PATENT NO. : 5,321,480

DATED : June 14, 1994

INVENTOR(S) : Thomas C. Merie, Kevin M. Johnson

It is certified that error appears in the above-indentified patent and that said Letters Patent is hereby corrected as shown below:

Column 5, line 48, delete "on" and substitute --of --.

Signed and Sealed this

Sixth Day of September, 1994

*Attest:*

*Attesting Officer*

Bruce Lehman

BRUCE LEHMAN

*Commissioner of Patents and Trademarks*